US011299941B2

(12) United States Patent
Donohoe et al.

(10) Patent No.: US 11,299,941 B2
(45) Date of Patent: Apr. 12, 2022

(54) PUMP JACK WITH COUNTERBALANCE

(71) Applicant: VERTX ARTIFICIAL LIFT INC., Edmonton (CA)

(72) Inventors: Nicholas Paul Donohoe, Edmonton (CA); Lee Douglas Basset, Lloydminster (CA)

(73) Assignee: Vertx Artificial Lift Inc., Edmonton (CA)

( * ) Notice: Subject to any disclaimer, the term of this patent is extended or adjusted under 35 U.S.C. 154(b) by 233 days.

(21) Appl. No.: 16/459,380

(22) Filed: Jul. 1, 2019

(65) Prior Publication Data

US 2021/0003124 A1 Jan. 7, 2021

(51) Int. Cl.
*F04B 47/14* (2006.01)
*E21B 19/086* (2006.01)
(Continued)

(52) U.S. Cl.
CPC ..... *E21B 19/089* (2013.01); *E21B 19/086* (2013.01); *E21B 43/127* (2013.01);
(Continued)

(58) Field of Classification Search
CPC ..... F04B 47/02; F04B 47/14; F04B 47/022; F04B 47/145; F04B 47/04; E21B 19/086; E21B 19/089; E21B 43/127
See application file for complete search history.

(56) References Cited

U.S. PATENT DOCUMENTS 2,681,623 A * 6/1954 Kane ..... F04B 47/00 417/399
3,659,655 A * 5/1972 Gyongyosi ..... E21B 19/08 173/1
(Continued)

FOREIGN PATENT DOCUMENTS

CA 2873344 9/2013
WO WO-2014165831 A1 * 10/2014 ..... F04B 49/065

OTHER PUBLICATIONS

Yu, Study of new hydraulic pumping unit based on the offshore platform, 2016, Energy Science & Engineering, pp. 352-360 (Year: 2016).*

*Primary Examiner* — Kenneth J Hansen
*Assistant Examiner* — David N Brandt
(74) *Attorney, Agent, or Firm* — Christensen O'Connor Johnson Kindness PLLC

(57) ABSTRACT

A pump jack with counterbalance system is provided, including a supporting structure, a linear actuator with a housing and a shaft, a first pulley carried by the shaft, a second pulley fixed above the first pulley, an elongate flexible member, and a weight cared by the shaft. The housing is vertically oriented and mounted to the supporting structure above a ground surface. The shaft has a first end received within the housing and a connection end that extends out of the housing and carries the first pulley and the weight. The linear actuator drives the shaft between extended and retracted positions. The elongate member
(Continued)

passes around the pulleys and has a first end fixed relative to the housing and a second end connected to a surface rod, such that reciprocating movement of the shaft causes the surface rod to move vertically and the weight to act as a mechanical counterbalance.

9 Claims, 4 Drawing Sheets

(51) Int. Cl.

| | |
|---|---|
| ***E21B 19/089*** | (2006.01) |
| ***E21B 43/12*** | (2006.01) |
| ***F04B 47/04*** | (2006.01) |
| ***F04B 47/02*** | (2006.01) |

(52) U.S. Cl.
CPC ..... *F04B 47/022* (2013.01); *F04B 47/04* (2013.01); *F04B 47/145* (2013.01)

(56) References Cited

U.S. PATENT DOCUMENTS

| | | | | | |
|---|---|---|---|---|---|
| 4,099,447 | A | | 7/1978 | Ogles | |
| 4,187,680 | A | | 2/1980 | Sanford | |
| 4,191,016 | A | | 3/1980 | Roth et al. | |
| 4,430,924 | A | | 2/1984 | Dunn et al. | |
| 4,480,685 | A | | 11/1984 | Gilbertson | |
| 4,497,616 | A | * | 2/1985 | Ratell, Jr. ..... | F04B 47/04 417/390 |
| 4,696,221 | A | | 9/1987 | Dollison | |
| 4,712,374 | A | | 12/1987 | Stewart | |
| 4,761,120 | A | | 8/1988 | Mayer et al. | |
| 4,801,126 | A | | 1/1989 | Rosman | |
| 5,018,350 | A | * | 5/1991 | Bender ..... | F04B 47/04 417/400 |
| 5,168,937 | A | * | 12/1992 | Hamner ..... | E21B 19/084 173/4 |
| 5,536,150 | A | | 7/1996 | Tucker | |
| 6,116,025 | A | | 9/2000 | Tucker | |
| 7,530,799 | B2 | | 5/2009 | Smith | |
| 8,851,860 | B1 | | 10/2014 | Mail | |
| 9,631,463 | B2 | | 4/2017 | Tao et al. | |
| 9,745,975 | B2 | | 8/2017 | Dancek | |

* cited by examiner

PUMP JACK WITH COUNTERBALANCE

TECHNICAL FIELD

This relates to pumping fluid from wells, and in particular, to providing a pump jack system with a balanced rod.

BACKGROUND

During the removal of fluids from underground wells, artificial lift systems are often used to pump fluids out of the well. These downhole pumps are generally rotary pumps, or reciprocating pumps, which may be driven by a pumping jack on surface. An example of such a pumping jack with a counterbalance system is described in U.S. Pat. No. 4,191,016 entitled PUMPING JACK (Roth et. al.).

SUMMARY

According to an aspect, there is provided a pump jack with counterbalance system, comprising a supporting structure, a linear actuator comprising a housing and a shaft, the housing being vertically oriented and mounted to the supporting structure above a ground surface, the shaft having a first end movably received within the housing and having a connection end that extends out of a bottom end of the housing, the linear actuator driving the shaft between an extended position and a retracted position, a first pulley carried by the connection end of the shaft, a second pulley fixed relative to the supporting structure above the first pulley, an elongate flexible member, having a first end fixed relative to the housing of the linear actuator and a second end connected to a surface rod, the elongate flexible member passing around the first pulley and the second pulley, such that reciprocating movement of the shaft causes the surface rod to move vertically, and a weight carried by the connection end of the shaft, the weight acting as a mechanical counterbalance.

According to other aspects, the pump jack may further comprise an accumulator in communication with the linear actuator, the accumulator selectively acting as a counterbalance, the weight and the accumulator may act in combination to reduce the force required to drive the surface rod, the accumulator may apply fluid pressure to act as a pressure counterbalance, the pump jack may further comprise a controller that controls the fluid pressure applied by the accumulator in response to a changing force required to drive the surface rod, the weight may be adjustable, the weight may be adjustable to be similar to the weight of the surface rod, and the accumulator may be adjustable such that the combined counterbalance provided by the weight and the accumulator balances the weight of the surface rod, the linear actuator may comprise a hydraulic cylinder having a first drive chamber and a second drive chamber and the pump jack may further comprise a hydraulic pump in fluid communication with the first drive chamber and the second drive chamber, and the hydraulic cylinder may further comprise an accumulator chamber and the pump jack may further comprise an accumulator in fluid communication with the accumulator chamber of the hydraulic cylinder, the accumulator applying fluid pressure to act as a pressure counterbalance.

According to an aspect, there is provided a method of counterbalancing a pump jack, the method comprising the steps of providing a pump jack comprising a supporting structure, a linear actuator comprising a housing and a shaft, the housing being vertically oriented and mounted to the supporting structure above a ground surface, the shaft having a first end movably received within the housing and having a connection end that extends out of a bottom end of the housing, a first pulley carried by the connection end of the shaft, a second pulley fixed relative to the supporting structure above the first pulley, and an elongate flexible member, having a first end fixed relative to the housing of the linear actuator and a second end, the elongate flexible member passing around the first pulley and the second pulley, attaching a surface rod to the second end of the elongate flexible member, reducing the force required to drive the surface rod by attaching a weight to the connection end of the shaft such that the weight acts as a mechanical counterbalance and driving the shaft of the linear actuator between an extended position and a retracted position, reciprocating movement of the shaft causing the surface rod to move vertically.

According to other aspects, the method may further comprise the step of attaching an accumulator in communication with the linear actuator, the accumulator selectively acting as a counter balance, the force required to drive the surface rod may be reduced by the weight and the accumulator acting in combination, the accumulator may apply fluid pressure to act as a pressure counterbalance, the method may further comprise the step of controlling the fluid pressure applied by the accumulator in response to a changing force required to drive the surface rod, and may comprise the step of adjusting the weight, reducing the force required to drive the surface rod may comprise adjusting the weight to be similar to the weight of the surface rod, and adjusting the fluid pressure in the accumulator such that the combined counterbalance provided by the weight and the accumulator balances the weight of the surface rod, the linear actuator may comprise a hydraulic cylinder having a first drive chamber and a second drive chamber and the pump jack may further comprise a hydraulic pump in fluid communication with the first drive chamber and the second drive chamber, and the hydraulic cylinder may further comprise an accumulator chamber, and the step of reducing the force required to drive the surface rod may further comprise connecting an accumulator in fluid communication with the accumulator chamber of the hydraulic cylinder, the accumulator applying fluid pressure to act as a pressure counterbalance.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION OF PREFERRED EMBODIMENTS

Figure 4:
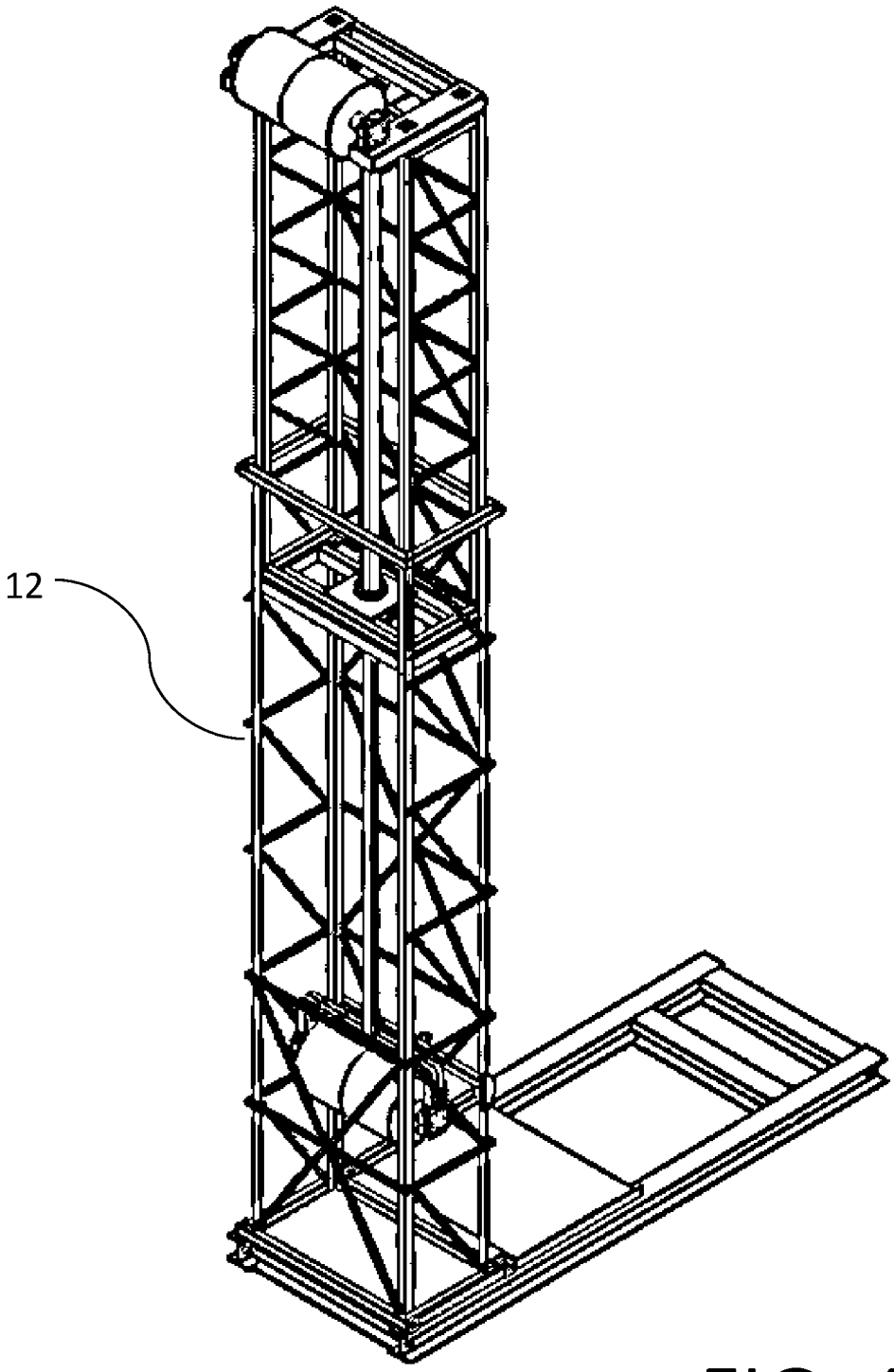
FIG. 4 is a perspective view of a telescoping pump jack after being set up.

A pump jack with a counterbalance system, generally identified by reference numeral 10, will now be described with reference to FIG. 1 and FIG. 4.

Figure 1:
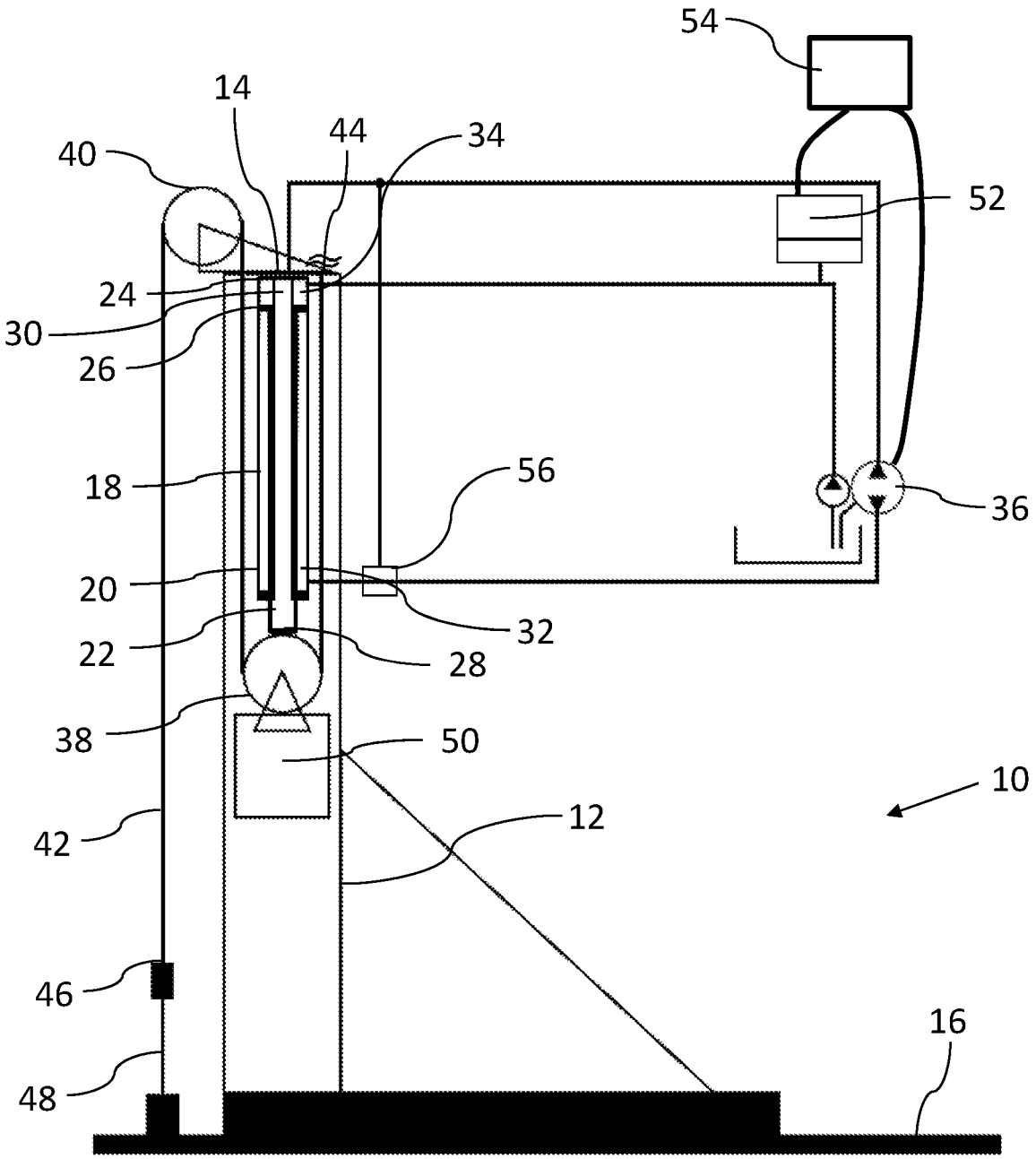
FIG. 1 is a schematic side elevation view of a hydraulic pump jack in a first position.
Figure 2:
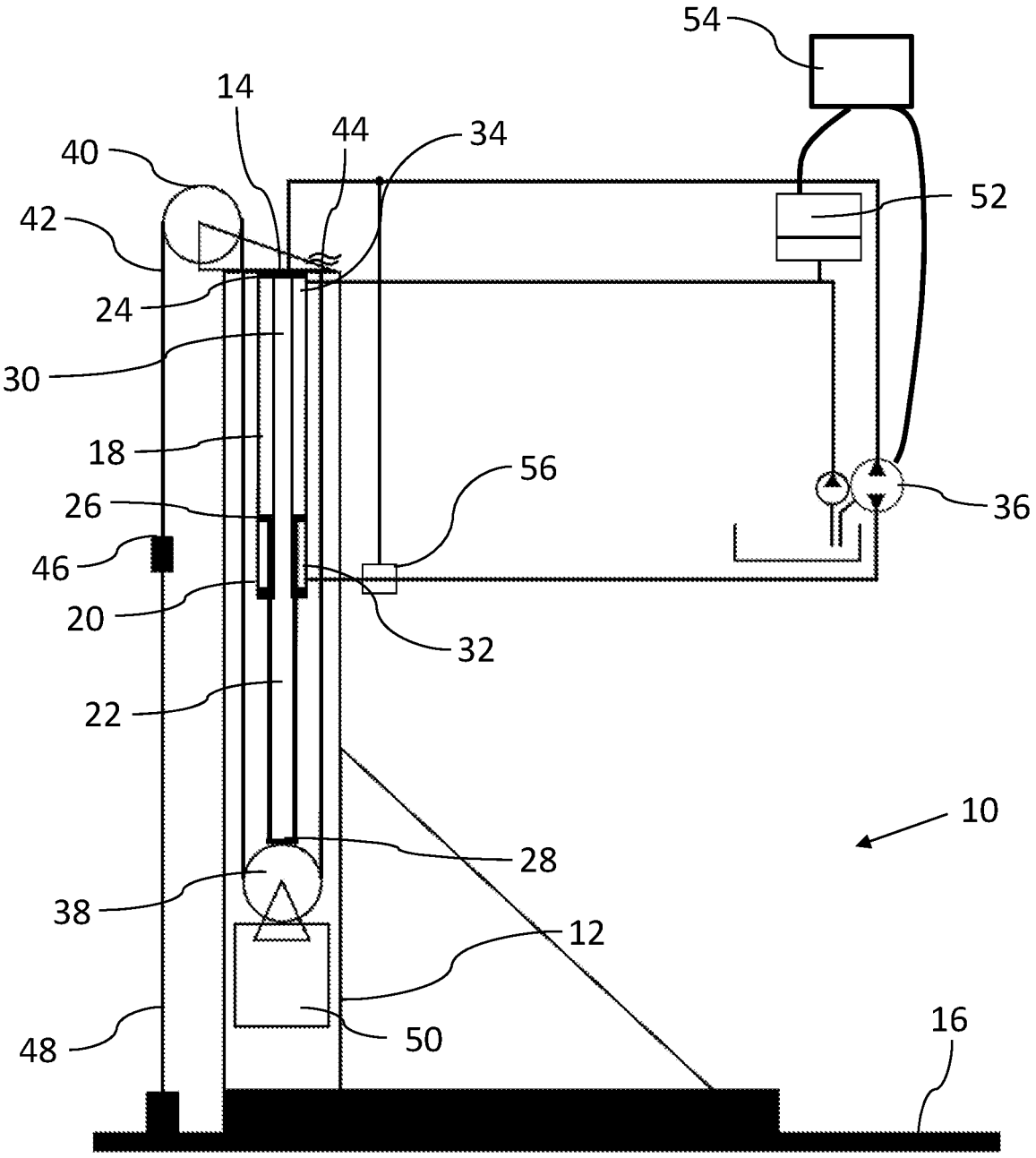
FIG. 2 is a schematic side elevation view of a hydraulic pump jack in a second position.

Referring to FIG. 1, pump jack 10 is shown, having a supporting structure 12 and a linear actuator 18 with a housing 20 and a shaft 22. In the depicted embodiment, as will be discussed further below, linear actuator 18 is a hydraulic actuator, however, it will be understood that this may be replaced by a number of other linear actuators as are known in the art, such as a rack and pinion actuator, or a ball and screw actuator. It will also be understood that the linear actuator may be made up of multiple linear actuators, such as multiple hydraulic cylinders, depending on the requirements of the particular application. Housing 18 is vertically oriented and mounted to supporting structure 12 above a ground surface 16. As shown, housing 18 is mounted at the top of supporting structure 12. However, it will be understood that this mounting may be at any location along supporting structure 12, and may vary based on the operation of hydraulic pump jack 10. Shaft 22 has a first end 26 within housing 20 and a connection end 28 that extends out of a bottom end of housing 20. Linear actuator 18 drives shaft 22 between an extended position, as shown in FIG. 2, and a retracted position, as shown in FIG. 1. A first pulley 38 is carried by connection end 28 of shaft 22, and a second pulley 40 is fixed relative to supporting structure 12 above first pulley 38. Second pulley 40 may, for example, be rotatably attached to supporting structure 12, or may be supported by housing 20 or on a separate structure. An elongate flexible member 42 has a first end 44 fixed relative to housing 20 of linear actuator 18 and a second end 46 connected to a surface rod 48. First end 44 may, for example, be fixedly attached to a portion of the overall pump jack structure, such as to supporting structure 12, directly to housing 20, or to a separate structure. Surface rod 48 may be a polish rod or any other suitable attachment that is attaches at a surface to an elongate member that is used to drive a reciprocating pump. Surface rod 48 may be as simple as a connection to a downhole elongate member such as a sucker rod string. Elongate flexible member 42 passes around first pulley 38 and second pulley 40, such that reciprocating movement of shaft 22 causes surface rod 48 to move vertically. A weight 50 is carried by connection end 28 of shaft 22, such that is moves vertically below linear actuator 18 and acts as a mechanical counterbalance.

Pump jack 10 may also have an accumulator 52 in communication with linear actuator 18 that selectively operates as a counterbalance to the weight of surface rod 48. Depending on the requirements of the situation, weight 50 and accumulator 52 may act in combination to reduce the force required to drive surface rod 48. For example, accumulator 52 may apply fluid pressure in order to act as a pressure counterbalance. This fluid pressure may be controlled by a controller 54 to adjust the fluid pressure in response to a changing force required to drive surface rod 48. However, accumulator 52 may take other forms as are known in the art, such as an electricity storage accumulator or battery bank. Weight 50 may also be adjustable, and weight 50 and accumulator 52 may be adjusted in combination such that the combined counterbalance balances the weight of surface rod 48.

Referring to FIG. 1, an embodiment where pump jack 10 is a hydraulic pump jack 10 that is driven using a hydraulic cylinder 18 that has a barrel 20 and a rod 22 will be discussed. As shown, hydraulic cylinder 18 is in a vertical, inverted orientation such that atop end 24 of barrel 20 is mounted to top support 14 of supporting structure 12 and rod 22 extends downward toward ground surface 16 from barrel 20. Hydraulic cylinder 18 may be mounted to support 14 at other positions along its length that allow for its use in a vertical, inverted orientation within hydraulic pump jack 10. Rod 22 has a piston end 26 movably received within barrel 20 and a connection end 28 that extends out of a bottom end of barrel 20. As such, when hydraulic cylinder 18 moves to an extended position, connection end 28 moves down toward ground surface 16, and moves up when hydraulic cylinder 18 moves to a retracted position.

In the depicted embodiment, hydraulic cylinder 18 has a first drive chamber 30, a second drive chamber 32, and an accumulator chamber 34. As shown, first drive chamber 30 is formed within rod 22, which is hollow. Second drive chamber 32 is formed in the annular space between rod 22 and barrel 20, and toward connection end 28 of rod 22 relative to piston end 26. The surface area that is acted upon by hydraulic fluid within first and second drive chambers 30 and 32 is designed to be similar, and alternatingly applying pressure to each chamber drives the reciprocating movement of hydraulic cylinder 18. It will be understood that these surface areas may be substantially the same, or they may allowed to differ. Accumulator chamber 34 is formed in the annular space between rod 22 and barrel 20, and on the opposite side of piston end 26 relative to second drive chamber 32, and is used as part of the counterbalance system, as will be discussed below.

As shown, hydraulic pump 36 is in fluid communication with first drive chamber 30 and second drive chamber 32, and is used to drive rod 22 between the retracted position shown in FIG. 1 and the extended position shown in FIG. 2 by pumping fluid into the respective chamber 30 or 32. A first pulley 38 is carried by connection end 28 of rod 22, and a second pulley 40 is rotatably attached to supporting structure 12. An elongate flexible member 42 has a first end 44 connected to supporting structure 12 and a second end 46 connected to surface rod 48. Elongate flexible member 42 passes around first pulley 38 and second pulley 40, such that reciprocating movement of rod 22 of hydraulic cylinder 18 causes surface rod 48 to move vertically. Elongate flexible member 42 may take a variety of forms as are known in the art, such as a belt, chain, cable, etc. The length of elongate flexible member 42 may be varied if required, such as to accommodate different lengths of surface rod 48, different stroke lengths of the downhole pump, or for different well depths.

As noted above, hydraulic cylinder 18 is counterbalanced by counterweights. In particular, hydraulic cylinder 18 is counterbalanced by a mechanical counterweight, and a fluid counterweight.

Referring to FIG. 1, a weight 50 is carried by connection end 28 of rod 22. Weight 50 acts as a mechanical counterbalance and may be adjustable, such as based on the weight of surface rod 48. An accumulator 52 may also be provided in fluid communication with accumulator chamber 34 of hydraulic cylinder 18 to apply fluid pressure to hydraulic cylinder 18 to act as a pressure counterbalance. Accumulator 52 may also be adjustable. It will be understood that the term "fluid" refers to either a liquid or a gas, and that the fluid pressure provided by the counterbalance may be hydraulic pressure, or pneumatic pressure. Weight 50 and accumulator 52 act to reduce the force required to drive surface rod 48, and each may be adjusted such that the combined counterbalance provided by weight 50 and accumulator 52 acts against the weight of surface rod 48 to the desired degree. Generally speaking, while both weight 50 and accumulator 52 are adjustable, it is possible to adjust accumulator 52 as needed and without stopping the operation of hydraulic cylinder. As such, in one example, weight 50 may be provided to be a rough estimate of the weight required to balance the operation of hydraulic cylinder 18 based primarily on the weight of surface rod 48, and accumulator 52 may then be adjusted to fully counterbalance the weight of surface rod 48 as it moves. In this way, the same force may be applied by hydraulic pump 36 to both lift and lower surface rod 48 in a pumping operation. In other examples, a desired counterbalance other than an equally balanced mode may be achieved by adjusting weight 50 and accumulator 52 as desired. As noted above, weight 50 is preferably used as the coarse adjustment, and accumulator 52 is preferably used as the fine adjustment, however it is also possible to stop the operation of hydraulic cylinder 18 to adjust weight 50 if desired. It will also be understood that, for particular operating conditions, pumpjack 10 may be capable of operation without either method of counterbalance, or pumpjack 10 may operate with only the mechanical counterweight, or only the fluid counterbalance.

As can be seen, hydraulic cylinder 18 is inverted, such that in the event of a failure, rod 22 and weight 50 will fall toward ground surface 16. This acts to reduce the potential damage that may be incurred relative to other arrangements of pumpjack 10. As an additional safety measure, a load holding valve 56 may be provided in connection with the fluid lines for hydraulic pump 36. Load holding valve may act to isolate fluid chamber 32 in order to slow or prevent the fall of rod 22. Load holding valve 56 is used to prevent the uncontrolled drop of rod 22 in the event of a failure by sealing the hydraulic lines.

A controller 54 may be provided that controls the fluid pressure applied by accumulator 52 in response to a changing force required to drive surface rod 48. Controller 54 may also control hydraulic pump 36. Controller 54 may be programmed to automatically vary the counterbalance load provided by accumulator 52 by varying the pressure in accumulator 52 to account for changes in well condition. Controller 54 may also control the motion profile of surface rod 48, the speed of pump 36, the frequency of the reciprocations of rod 22, or other variables in the operation of hydraulic pump jack 10. In addition, hydraulic cylinder 18 may be controlled such that in the event of a failure, such as a breakage of elongate flexible member 42 or rod 48, hydraulic cylinder 18 may be used to slow the descent of weight 50, and weight 50 may be lowered to the base of support structure 12. Controller 54 may be connected to various sensors, such as pressure sensors speed sensors, load sensors, location sensors, etc. to provide controller 54 with the information required to control pumpjack 10 as desired.

A method of counterbalancing a pump jack 10 will now be described. Pump jack 10 as described above is provided, and surface rod 48 is attached to second end 46 of elongate flexible member 42. The force required to drive this surface rod is reduced by attaching weight 50 to connection end 28 of shaft 22 such that weight 50 acts as a mechanical counterbalance. Shaft 22 is then driven between extended and retracted positions, the reciprocating movement causing surface rod 48 to move vertically. An accumulator 52 may also be attached to selectively act as a counterbalance, and the force required to drive surface rod 48 may be reduced by weight 50 and accumulator 52 acting in combination. Accumulator 52 may apply fluid pressure to act as a pressure counterbalance, and both weight 50 and accumulator 52 may be adjustable.

The method of counterbalancing pump jack 10 will now be described in the context of the hydraulic pump jack 10, discussed above, and shown in FIG. 1 and FIG. 2. Surface rod 48 is attached to second end 46 of elongate flexible member 42. The force required to drive surface rod 48 is reduced by attaching weight 50 to connection end 28 of rod 22 of hydraulic cylinder 18 such that weight 50 acts as a mechanical counterbalance, and connecting accumulator 52 in fluid communication with accumulator chamber 34 of hydraulic cylinder 18, accumulator 52 applying fluid pressure to act as a pressure counterbalance. The fluid pressure applied by accumulator 52 may be controlled by controller 54 in response to a changing force required to drive surface rod 48. Rod 22 of hydraulic cylinder 18 is driven between an extended position as shown in FIG. 2 and a retracted position as shown in FIG. 1 using hydraulic pump 36, and the reciprocating movement of rod 22 of hydraulic cylinder 18 causes surface rod 48 to move vertically. In the event of a failure, hydraulic cylinder 18 may be controlled to slow the descent of weight 50. Hydraulic pump jack 10 may also operate with only one method of counterbalance, as discussed above, or may not require counterbalance for a given operating condition. In addition, accumulator chamber 34 may be capable of venting in order to allow for selective use of the pressure counterbalance.

Figure 3:
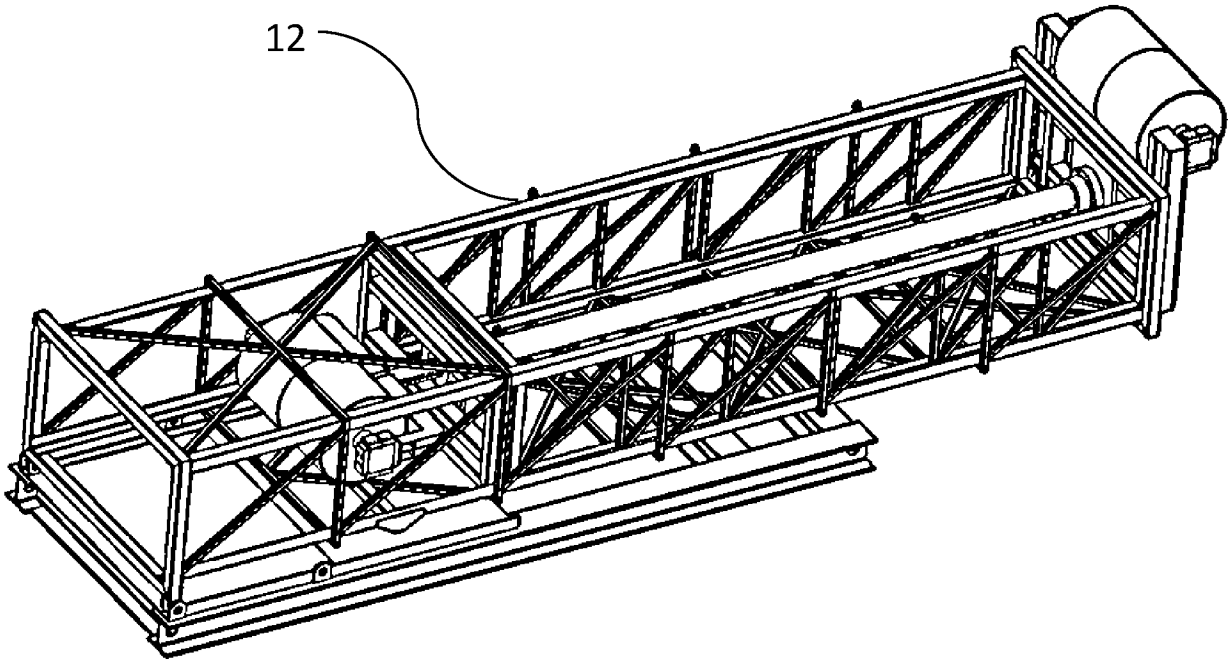
FIG. 3 is a perspective view of a telescoping pump jack prior to set up.

Hydraulic pump jack 10 may have a supporting structure 12 that is telescopic, such that the dimensions of supporting structure 12 may be reduced for packaging and transportation. This is shown in FIG. 3 and FIG. 4. In addition, one or more a hydraulic cylinders (s) may be provided that operates to lift supporting structure 12 from horizontal to vertical during setup, to retract supporting structure 12 from the wellhead for well servicing while supporting structure 12 is in the vertical position, and to assist with removal of the physical counterweights.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth m the examples above and in the drawings, but should be given the broadest interpretation consistent with the description as a whole.

What is claimed is:

1. A pump jack with a counterbalance system, comprising:

a supporting structure;

a linear actuator comprising a housing and a shaft, the housing being vertically oriented and mounted to the supporting structure above a ground surface, the shaft having a first end movably received within the housing and having a connection end that extends out of a bottom end of the housing;

the linear actuator driving the shaft between an extended position and a retracted position;

a first pulley carried by the connection end of the shaft;

a second pulley fixed relative to the supporting structure above the first pulley;

an elongate flexible member, having a first end fixed relative to the housing of the linear actuator and a second end connected to a surface rod, the elongate flexible member passing around the first pulley and the second pulley, such that reciprocating movement of the shaft causes the surface rod to move vertically; and a weight carried by the connection end of the shaft, the weight acting as a mechanical counterbalance.

2. The pump jack of claim 1, further comprising an accumulator in communication with the linear actuator, the accumulator selectively acting as a counterbalance.

3. The pump jack of claim 2, wherein the weight and the accumulator act in combination to reduce a force required to drive the surface rod.

4. The pump jack of claim 2, wherein the accumulator applies fluid pressure to act as a pressure counterbalance.

5. The pump jack of claim 4, further comprising a controller that controls the fluid pressure applied by the accumulator in response to a changing force required to drive the surface rod.

6. The pump jack of claim 1, wherein the weight is adjustable.

7. The pump jack of claim 2, wherein the weight is adjustable to be similar to the weight of the surface rod, and wherein the accumulator is adjustable such that the combined counterbalance provided by the weight and the accumulator balances the weight of the surface rod.

8. The pump jack of claim 1, wherein:

the linear actuator comprises a hydraulic cylinder having a first drive chamber and a second drive chamber; and the pump jack further comprises a hydraulic pump in fluid communication with the first drive chamber and the second drive chamber.

9. The pump jack of claim 8, wherein the hydraulic cylinder further comprises an accumulator chamber and the pump jack further comprises an accumulator in fluid communication with the accumulator chamber of the hydraulic cylinder, the accumulator applying fluid pressure to act as a pressure counterbalance.

* * * * *